US006581030B1

(12) United States Patent
Su

(10) Patent No.: US 6,581,030 B1
(45) Date of Patent: Jun. 17, 2003

(54) TARGET SIGNAL REFERENCE SHIFTING EMPLOYED IN CODE-EXCITED LINEAR PREDICTION SPEECH CODING

(75) Inventor: Huan-yu Su, San Clemente, CA (US)

(73) Assignee: Conexant Systems, Inc., Newport Beach, CA (US)

( * ) Notice: Subject to any disclaimer, the term of this patent is extended or adjusted under 35 U.S.C. 154(b) by 0 days.

(21) Appl. No.: 09/548,205

(22) Filed: Apr. 13, 2000

(51) Int. Cl.[7] ..... G10L 19/02; G10L 19/08
(52) U.S. Cl. ..... 704/219; 704/220; 704/223
(58) Field of Search ..... 704/223, 200, 704/219, 220–222, 216, 233, 261, 262, 500, 504

(56) References Cited

U.S. PATENT DOCUMENTS

| | | | | | |
|---|---|---|---|---|---|
| 5,704,003 | A | * | 12/1997 | Kleijn et al. | 704/220 |
| 6,029,128 | A | * | 2/2000 | Jarvinen et al. | 704/220 |
| 6,108,624 | A | * | 8/2000 | Park | 704/221 |
| 6,233,550 | B1 | * | 5/2001 | Gersho et al. | 704/208 |
| 6,272,196 | B1 | * | 8/2001 | Wuppermann et al. | 375/377 |
| 6,311,154 | B1 | * | 10/2001 | Gersho et al. | 704/219 |
| 6,336,092 | B1 | * | 1/2002 | Gibson et al. | 704/268 |

* cited by examiner

*Primary Examiner*—Daniel Abebe
(74) *Attorney, Agent, or Firm*—Christopher J. Rourk; Akin, Gump, Strauss, Hauer & Feld, LLP

(57) ABSTRACT

A speech coding system that employs target signal reference shifting in code-excited linear prediction speech coding. The speech coding system performs modification of a target signal that is used to perform speech coding of a speech signal. The modified target signal that is generated from a preliminary target signal is then used to calculate an adaptive codebook gain that is used to perform speech coding of the speech signal. The speech coding performed in accordance with the present invention provides for a substantially reduced bit-rate of operation when compared to conventional speech coding methods that inherently require a significant amount of bandwidth to encode a fractional pitch lag delay during pitch prediction that is performed within conventional code-excited linear prediction speech coding systems. The speech coding system of the present invention nevertheless provides for speech coding wherein a reproduced speech signal, generated from the encoded speech signal, is substantially perceptually indistinguishable from the original speech signal. In certain embodiments of the invention, the invention provides for an alternative speech coding method that is invoked at times within the speech coding system when the conservation of bandwidth is more desirable than maintaining a high level of complexity. This instance arises frequently in relatively low bit-rate speech coding applications. The present invention is ideally operable within such low bit-rate speech coding applications.

24 Claims, 7 Drawing Sheets

TARGET SIGNAL REFERENCE SHIFTING EMPLOYED IN CODE-EXCITED LINEAR PREDICTION SPEECH CODING

BACKGROUND

1. Technical Field

The present invention relates generally to speech coding; and, more particularly, it relates to target signal reference shifting within speech coding.

2. Related Art

Conventional speech coding systems tend to require relatively significant amounts of bandwidth to encode speech signals. Using conventional code-excited linear prediction techniques, waveform matching between a reference signal, an input speech signal, and a re-synthesized speech signal are all used as error criteria to perform speech coding of the speech signal. To provide a high perceptual quality of the re-synthesized speech signal, the relatively significant amounts of bandwidth are required within conventional speech coding systems. Specifically, to perform good matching and thereby providing a high perceptual quality of the re-synthesized speech signal, a high bit-rate is used to encode the fractional pitch lag delay during the calculation of pitch prediction. This use of relatively significant amounts of bandwidth, as necessitated to provide this high perceptual quality, are inherently costly and wasteful to low bitrate applications. This highly consumptive use of the available bandwidth is very undesirable for low bit-rate applications. The present art does not provide an adequate solution to encode the fractional pitch lag delay during the calculation of pitch prediction within conventional speech coding systems.

As speech coding systems continue to move toward lower bit-rate applications, the traditional solution of dedicating a high amount of bandwidth to the coding of the fractional pitch lag delay will prove to be one of the limiting factors, especially of those speech coding systems employing code-excited linear prediction speech coding. The inherent speech coding performed within the code-excited linear prediction speech coding method does not afford a good opportunity to reduce the bandwidth dedicated to coding the fractional pitch lag delay while still maintaining a high perceptual quality of reproduced speech, i.e., high perceptual quality of the re-synthesized speech signal.

Traditional methods of speech coding that use a target signal ($T_g$) to find an adaptive codebook gain ($g_p$) within code-excited linear prediction speech coding commonly calculate the target signal ($T_g$) by matching old frame of the speech signal to a new or current frame of the speech signal. This matching gives an adaptive codebook contribution ($C_p$) and subsequently the contribution provided by a speech synthesis filter (H) with it as shown by the following relation $$C_p \rightarrow C_p H$$

Subsequently, using the calculated target signal ($T_g$) and the combined contribution of the contribution ($C_p$) and the speech synthesis filter (H), namely $C_p$H. then the adaptive codebook gain ($g_p$) is uniquely solved by the following relation.

$$g_p \leftarrow \mathrm{Min}(T_g - g_p C_p H)^2$$

Further limitations and disadvantages of conventional and traditional systems will become apparent to one of skill in the art through comparison of such systems with the present invention as set forth in the remainder of the present application with reference to the drawings.

SUMMARY OF THE INVENTION

Various aspects of the present invention can be found in a code-excited linear prediction speech coding system that performs target signal reference shifting during encoding of a speech signal. The code-excited linear prediction speech coding system itself contains, among other things, a speech synthesis filter and the speech synthesis filter contains a linear prediction coding synthesis filter and a perceptual weighting filter. The speech synthesis filter generates a target signal during encoding of the speech signal using the linear prediction coding synthesis filter and the perceptual weighting filter. In addition, the code-excited linear prediction speech coding system generates a modified target signal using the target signal that is generated during the encoding of the speech signal, and the code-excited linear prediction speech coding system generates an encoded speech signal during the encoding of the speech signal. Also, the code-excited linear prediction speech coding system is operable to decode the encoded speech signal to generate a reproduced speech signal, the reproduced speech signal is substantially perceptually indistinguishable from the speech signal prior to the encoding of the speech signal.

In certain embodiments of the invention, the code-excited linear prediction speech coding system is found within a speech codec. In some instances, the speech codec contains, among other things, an encoder circuitry and a decoder circuitry, and the modified target signal is generated within the encoder circuitry. If desired, the encoding of the speech signal is performed on a frame basis. Alternatively, the encoding of the speech signal is performed on a sub-frame basis. Within speech coder applications, the reproduced speech signal is generated using the modified target signal. In addition, the code-excited linear prediction speech coding system is operable within a speech signal processor. The code-excited linear prediction speech coding system is operable within a substantially low bit-rate speech coding system.

Other aspects of the present invention can be found in a speech coding system that performs target signal reference shifting of a speech signal. The speech coding system contains, among other things, a target signal calculation circuitry that generates a target signal and an adaptive codebook gain calculation circuitry that generates an adaptive codebook gain. The target signal corresponds to at least one portion of the speech signal, and the adaptive codebook gain is generated using the modified target signal.

Similar to the aspects of the invention can be found in the code-excited linear prediction speech coding system described above, the speech coding system of this particular embodiment of the invention is found with in a speech codec in certain embodiments of the invention. When the speech codec contains encoder circuitry, the speech coding system is contained within the encoder circuitry. Also, the speech coding system is operable within a speech signal processor.

In other embodiments of the invention, the speech coding system contains a speech synthesis filter. The speech synthesis filter contains a linear prediction coding synthesis filter and a perceptual weighting filter. If desired, the at least one portion of the speech signal that is used to encode the speech signal is extracted from the speech signal on a frame basis. Alternatively, the at least one portion of the speech signal that is used to encode the speech signal is extracted from the speech signal on a sub-frame basis. The speech coding system is operable within a substantially low bit-rate speech coding system.

Other aspects of the present invention can be found in a method that is used to perform target signal reference shifting on a speech signal. The method includes, among other things, calculating a target signal, modifying the target signal to generate a modified target signal, and calculating an adaptive codebook gain using the modified target signal. The target signal corresponds to at least one portion of the speech signal.

In certain embodiments of the invention, the method is performed on the speech signal on a frame basis; alternatively, the method is performed on a sub-frame basis. The generation of the modified target signal includes maximizing a correlation between the target signal and a product of an adaptive codebook contribution and a speech synthesis filter contribution. If further desired, the correlation is normalized during its calculation. The method is operable within speech coding system that operate using code-excited linear prediction.

Other aspects, advantages and novel features of the present invention will become apparent from the following detailed description of the invention when considered in conjunction with the accompanying drawings.

DETAILED DESCRIPTION OF THE INVENTION

Figure 1:
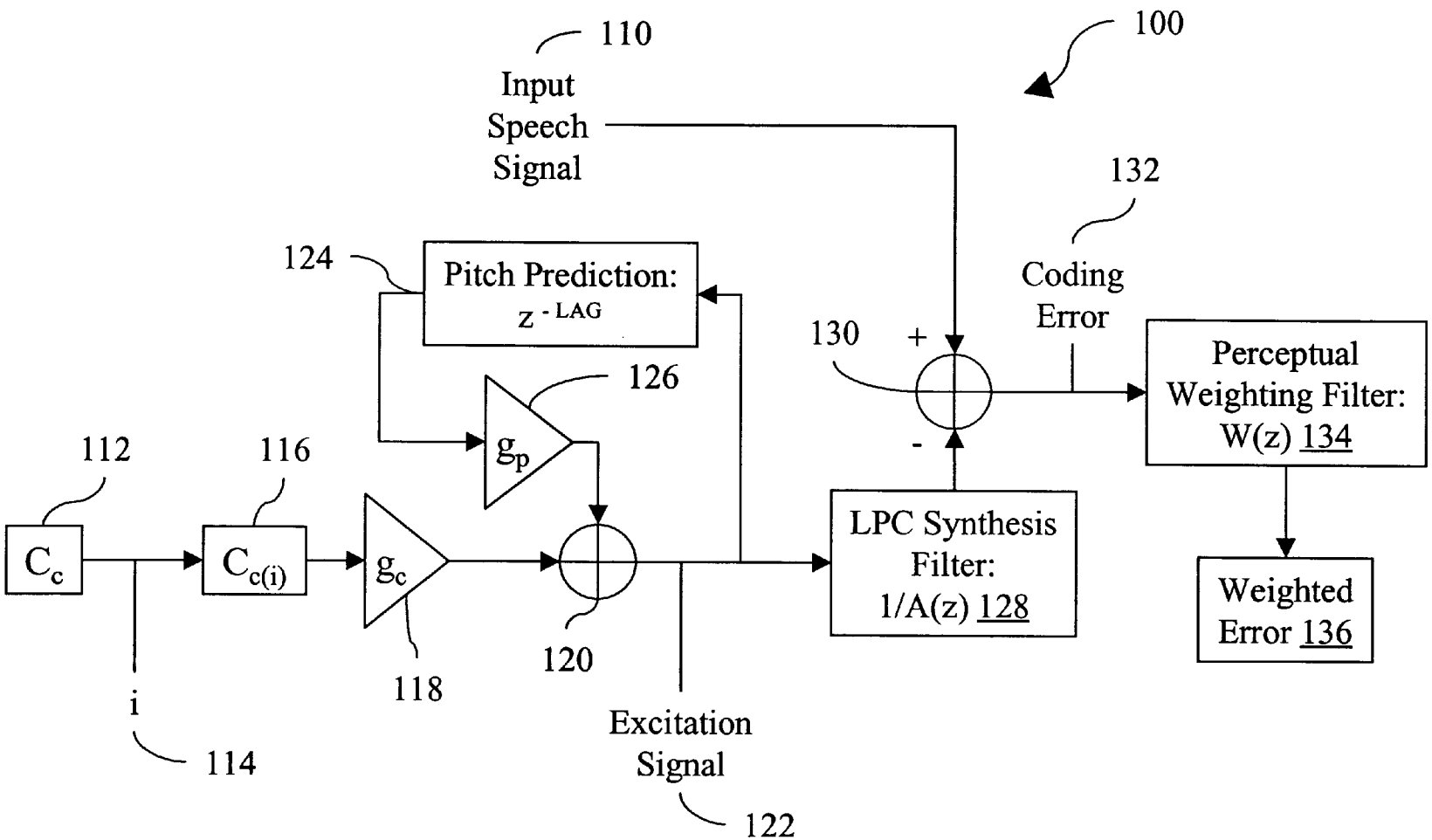
FIG. 1 is a system diagram illustrating one embodiment of a speech coding system built in accordance with the present invention.

FIG. 1 is a system diagram illustrating one embodiment of a speech coding system 100 built in accordance with the present invention. A speech signal is input into the speech coding system 100 as shown by the reference numeral 110. The speech signal is partitioned into a number of frames. If desired, each of the frames of the speech signal is further partitioned into a number of sub-frames. A given frame or sub-frame of the given frame is shown by the iteration 'i' associated with the reference numeral 114. For the given frame or sub-frame, a particular excitation vector ($C_{c(i)}$) 116 is selected from among a fixed codebook ($C_c$) 112. The selected excitation vector ($C_{c(i)}$) 116, chosen from among all of the excitation vectors contained within the fixed codebook ($C_c$) 112 for the given frame or sub-frame of the speech signal, is scaled using a fixed gain ($g_c$) 118. After having undergone any required scaling (either amplification or reduction) by the fixed gain ($g_c$) 118, the now-scaled selected excitation vector ($C_{c(i)}$) 116 is fed into a summing node 120. An excitation signal 122 is fed into the signal path of the now-scaled selected excitation vector ($C_{c(i)}$) 116 after the summing node 120. A feedback path is provided wherein pitch prediction is performed in the block 124 as shown by $z^{-LAG}$.

The output of this signal path, after having undergone the pitch prediction is performed in the block 124 as shown by $z^{-LAG}$, is then scaled using an adaptive codebook gain ($g_p$) 126. After having undergone any required scaling (either amplification or reduction) by the adaptive codebook gain ($g_p$) 126, this signal path is then fed into the summing node 120. The output of the summing node 120, is fed into a linear prediction coding (LPC) synthesis filter (1/A(z)) 128. The output of the linear prediction coding (LPC) synthesis filter (1/A(z)) 128 and the input signal 110 are both fed into another summing node 130 wherein their combined output is fed to a perceptual weighting filter W(z) 134. A coding error 132 is also fed into the signal path that is the output of the summing node 130, prior to the entrance of the signal path to the perceptual weighting filter W(z) 134. After the signal path has undergone any processing required by the perceptual weighting filter W(z) 134, a weighted error 136 is generated.

From certain perspectives, the target signal reference shifting performed in accordance with the present invention is performed in either one of the perceptual weighting filter W(z) 134 or the linear prediction coding (LPC) synthesis filter (1/A(z)) 128. The combination of both the linear prediction coding (LPC) synthesis filter (1/A(z)) 128 and the perceptual weighting filter W(z) 134 comprise the target signal reference shifting in other embodiments of the invention. The combination of both the linear prediction coding (LPC) synthesis filter (1/A(z)) 128 and the perceptual weighting filter W(z) 134 constitute a speech synthesis filter (H) in code-excited linear prediction speech coding. It is within this synthesis filter (H) that the target signal reference shifting, performed in accordance with the present invention, provides for, among other things, the ability to reduce number of bits required to encode a speech signal and specifically the fractional pitch lag delay that is calculated during pitch prediction of the speech coding of the speech signal.

Figure 2:
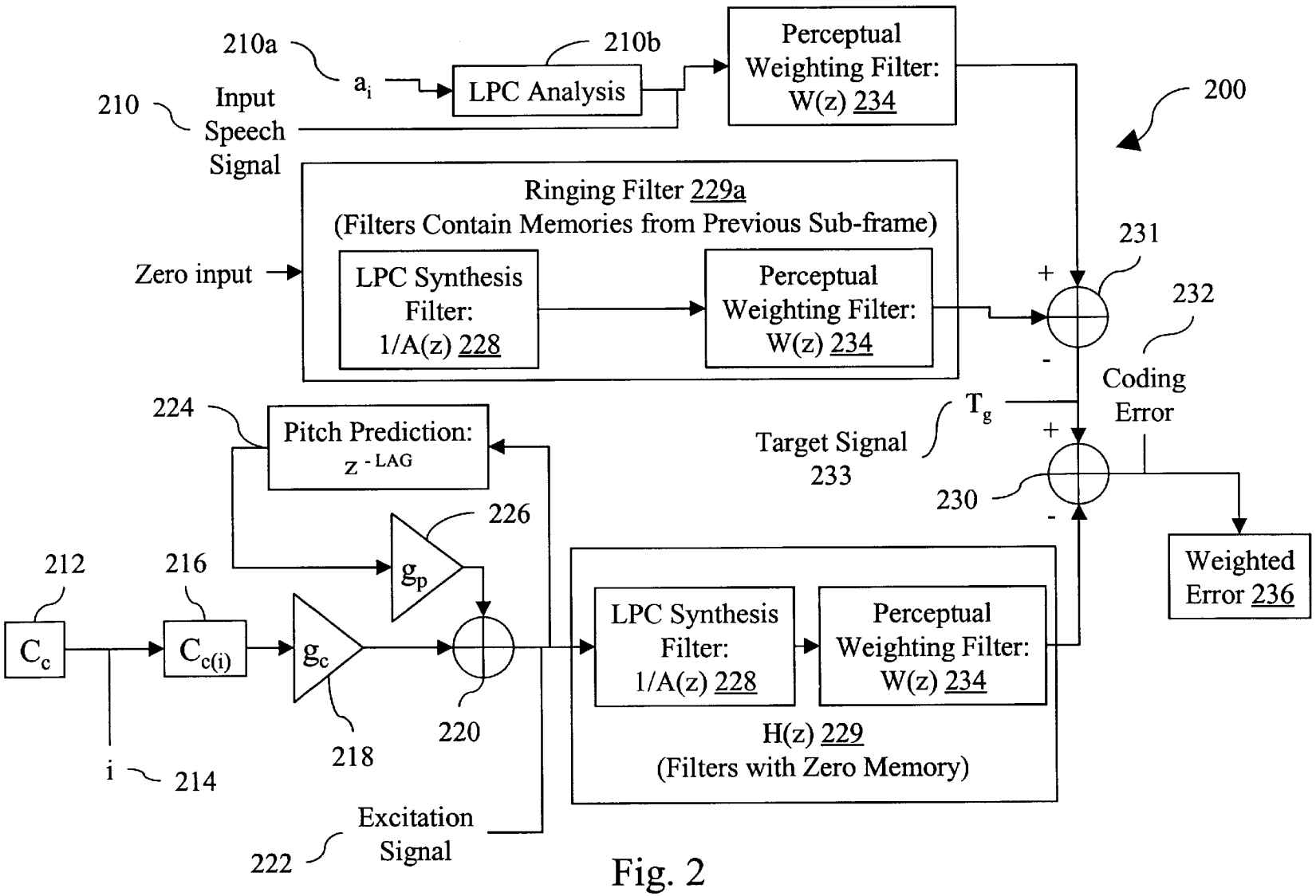
FIG. 2 is a system diagram illustrating another embodiment of a speech coding system built in accordance with the present invention.

FIG. 2 is a system diagram illustrating another embodiment of a speech coding system 200 built in accordance with the present invention. From certain perspectives, the speech coding system 200 is a specific embodiment of the speech coding system 100 illustrated above in the FIG. 1. While there are many similarities between the speech coding system 200 and the speech coding system 100, it is reiterated that the speech coding system 200 is one specific embodiment of the speech coding system 100, and that the speech coding system 100 includes not only the speech coding system 200, but additional embodiments of speech coding systems as well.

A speech signal is input into the speech coding system 200 as shown by the reference numeral 210. The speech signal is partitioned into a number of frames. If desired, each of the frames of the speech signal is further partitioned into a number of sub-frames. A given frame or sub-frame of the given frame is shown by the iteration 'i' associated with the reference numeral 214. For the given frame or sub-frame, a particular excitation vector ($C_{c(i)}$) 216 is selected from among a fixed codebook ($C_c$) 212. The selected excitation vector ($C_{c(i)}$) 216, chosen from among all of the excitation vectors contained within the fixed codebook ($C_c$) 212 for the given frame or sub-frame of the speech signal, is scaled using a fixed gain ($g_c$) 218. After having undergone any required scaling (either amplification or reduction) by the fixed gain ($g_c$) 218, the now-scaled selected excitation vector ($C_{c(i)}$) 216 is fed into a summing node 220. An excitation signal 222 is fed into the signal path of the now-scaled selected excitation vector ($C_{c(i)}$) 216 after the summing node 220. A feedback path is provided wherein pitch prediction is performed in the block 224 as shown by $z^{-LAG}$.

The output of this signal path, after having undergone the pitch prediction is performed in the block 224 as shown by $z^{-LAG}$, is then scaled using an adaptive codebook gain ($g_p$) 226. After having undergone any required scaling (either amplification or reduction) by the adaptive codebook gain ($g_p$) 226, this signal path is then fed into the summing node 220. The output of the summing node 220, is fed into a synthesis filter (H(z)) 229. The synthesis filter (H(z)) 229 itself contains, among other things, a linear prediction coding (LPC) synthesis filter (1/A(z)) 228 and a perceptual weighting filter W(z) 234. The output from the synthesis filter (H(z)) 229 is fed to a summing node 230.

In another signal path of the speech coding system 200, the input speech signal 210 is fed into a perceptual weighting filter W(z) 234. In addition, depending upon the particular frame or sub-frame of the speech signal that is being processed by the speech coding system 200 at the given time, as shown by the iteration '$a_i$' 210*a*, linear prediction coding (LPC) analysis 210*b* is performed, and the parameters derived during the linear prediction coding (LPC) analysis 210*b* are also fed into the perceptual weighting filter W(z) 234. The output of the perceptual weighting filter W(z) 234, within this signal path, is fed into a summing mode 231.

In addition, the output of a ringing filter 229*a* is also fed into the summing mode 231. The ringing filter 229*a* is a ringing filter that contains memories from a previous sub-frame of the speech signal during its processing within the speech coding system 200. The ringing filter 229*a* itself contains, among other things, a linear prediction coding (LPC) synthesis filter (1/A(z)) 228 and a perceptual weighting filter W(z) 234. Zero input is provided into the ringing filter 229*a*, as its output is generated only from the ringing effect from memories from the previous sub-frame. If desired, the memories of multiple previous sub-frames are used within the ringing filter 229*a* in certain embodiments of the invention. That is to say, the memories from a single previous sub-frame are not used, but the memories from a predetermined number of previous sub-frames of the speech signal. Alternatively, the ringing effect of the ringing filter 229*a*, with its zero input, is generated using multiple previous frames of the speech signal, and not simply previous sub frames. Varying numbers of previous portions of the speech signal are used to the ringing effect of the ringing filter 229*a* in other embodiments of the invention without departing from the scope and spirit of the speech coding system 200 illustrated in the FIG. 2.

From certain perspectives, borrowing upon the linear transformation performed within the speech coding system 200, the perceptual weighting filter W(z) 234, the perceptual weighting filter W(z) 234 contained within the ringing filter 229*a*, and the perceptual weighting filter W(z) 234 contained within the synthesis filter (H(z)) 229 having zero memory are all a single perceptual weighting filter W(z). That is to say, each of the individual components of the perceptual weighting filter W(z), shown in the various portions of the speech coding system 200, are all contained within a single integrated perceptual weighting filter W(z) within the speech coding system 200. From this perspective and for illustrative purposes, the perceptual weighting filter W(z) is shown as being translated into each of the various components described above. However, each of the illustrated portions of the perceptual weighting filter W(z) could also be located on the other side of the summing nodes 230 and 231 without altering the performance of the speech coding system 200. Again After the signal paths of the ringing filter 229*a* and that of the perceptual weighting filter W(z) 234 are combined within the summing node 231, their combined output is fed into the summing node 230. In the interim, before the output of the summing node 231 is fed into the summing node 230, a target signal ($T_g$) 233 is added to the signal path. Subsequently, the output of the summing node 230 is combined with a coding error 232 that is also fed into the signal path that is the output of the summing node 230. Finally, a weighted error 236 is generated by the speech coding system 200.

Figure 3:
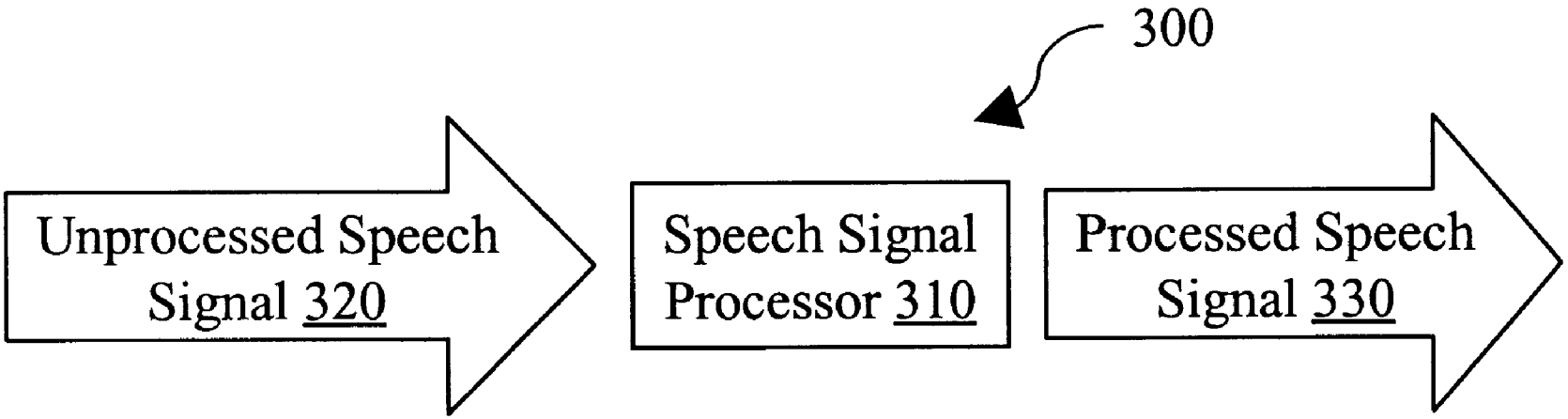
FIG. 3 is a system diagram illustrating an embodiment of a speech signal processing system built in accordance with the present invention.

FIG. 3 is a system diagram illustrating an embodiment of a speech signal processing system 300 built in accordance with the present invention. The speech signal processor 310 receives an unprocessed speech signal 320 and produces a processed speech signal 330.

In certain embodiments of the invention, the speech signal processor 310 is processing circuitry that performs the loading of the unprocessed speech signal 320 into a memory from which selected portions of the unprocessed speech signal 320 are processed in various manners including a sequential manner. The processing circuitry possesses insufficient processing capability to handle the entirety of the unprocessed speech signal 320 at a single, given time. The processing circuitry may employ any method known in the art that transfers data from a memory for processing and returns the processed speech signal 330 to the memory. In other embodiments of the invention, the speech signal processor 310 is a system that converts a speech signal into encoded speech data. The encoded speech data is then used to generate a reproduced speech signal that is substantially perceptually indistinguishable from the speech signal using speech reproduction circuitry. In other embodiments of the invention, the speech signal processor 310 is a system that converts encoded speech data, represented as the unprocessed speech signal 320, into decoded and reproduced speech data, represented as the processed speech signal 330. In other embodiments of the invention, the speech signal processor 310 converts encoded speech data that is already in a form suitable for generating a reproduced speech signal that is substantially perceptually indistinguishable from the speech signal, yet additional processing is performed to improve the perceptual quality of the encoded speech data for reproduction.

The speech signal processing system 300 is, in some embodiments, the speech coding system 100, or, alternatively, the speech coding system 200 as described in the FIGS. 1 and 2, respectively. The speech signal processor 310 operates to convert the unprocessed speech signal 320 into the processed speech signal 330. The conversion performed by the speech signal processor 310 is viewed, in various embodiments of the invention, as taking place at any interface wherein data must be converted from one form to another, i.e. from speech data to coded speech data, from coded data to a reproduced speech signal, etc.

Figure 4:
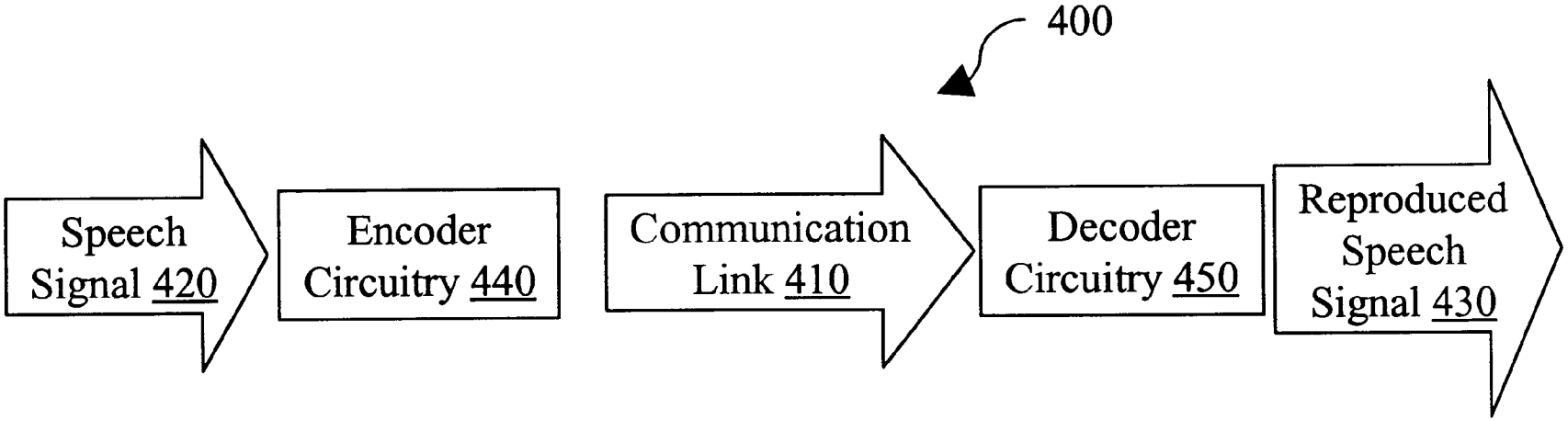
FIG. 4 is a system diagram illustrating an embodiment of a speech codec built in accordance with the present invention that communicates using a communication link.

FIG. 4 is a system diagram illustrating an embodiment of a speech codec 400 built in accordance with the present invention that communicates across a communication link 410. A speech signal 420 is input into an encoder circuitry 440 in which it is coded for data transmission via the communication link 410 to a decoder circuitry 450. The decoder processing circuit 450 converts the coded data to generate a reproduced speech signal 430 that is substantially perceptually indistinguishable from the speech signal 420.

In certain embodiments of the invention, the decoder circuitry 450 includes speech reproduction circuitry. Similarly, the encoder circuitry 440 includes selection circuitry that is operable to select from a plurality of coding modes. The communication link 410 is either a wireless or a wireline communication link without departing from the scope and spirit of the invention. Also, the communication link 410 is a network capable of handling the transmission of speech signals in other embodiments of the invention. Examples of such networks include, but are not limited to, internet and intra-net networks capable of handling such transmission. If desired, the encoder circuitry 440 identifies at least one perceptual characteristic of the speech signal and selects an appropriate speech signal coding scheme depending on the at least one perceptual characteristic. The speech codec 400 is, in one embodiment, a multi-rate speech codec that performs speech coding on the speech signal 420 using the encoder circuitry 440 and the decoder circuitry 450. The speech codec 400 is operable to employ code-excited linear prediction speech coding as well as a modified form of code-excited linear prediction speech coding capable of performing target signal reference shifting in accordance with the present invention.

Figure 5:
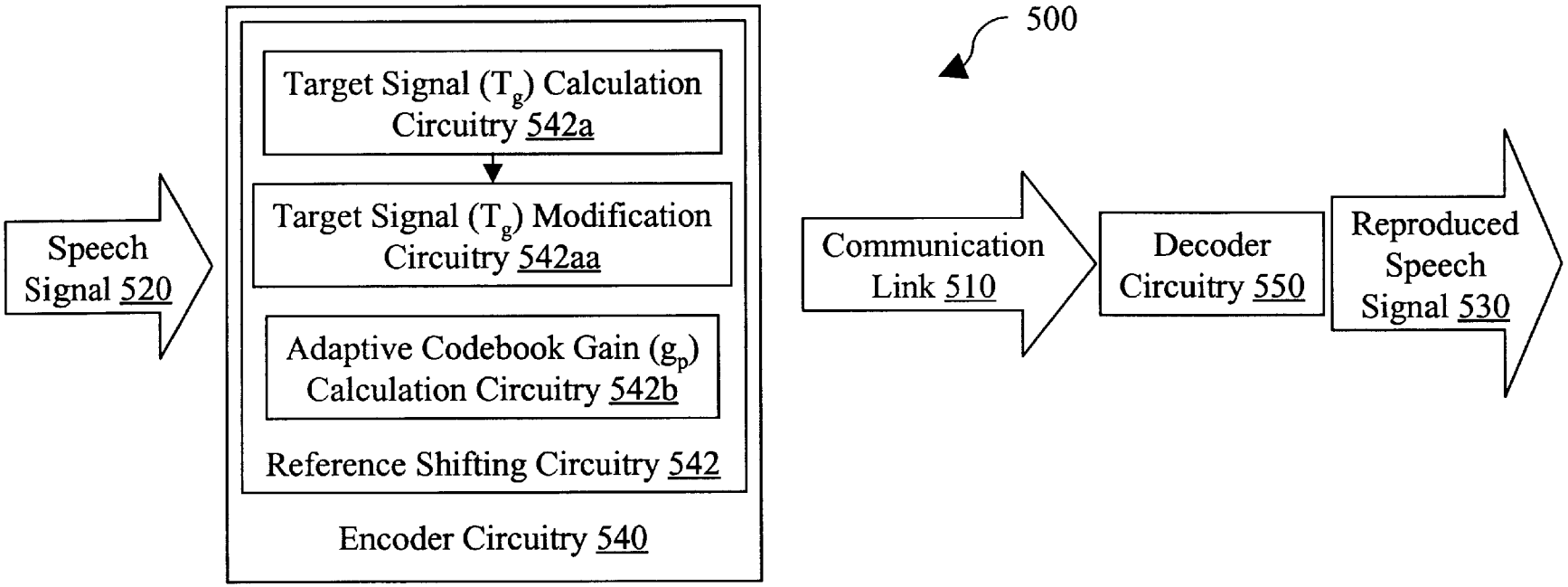
FIG. 5 is a system diagram illustrating an embodiment of a speech codec that is a specific embodiment of the speech codec illustrated above in FIG. 4.

FIG. 5 is a system diagram illustrating an embodiment of a speech codec 500 that is a specific embodiment of the speech codec 400 illustrated above in FIG. 4. The speech codec 500 communicates across a communication link 510. A speech signal 520 is input into an encoder circuitry 540 in which it is coded for data transmission via the communication link 510 to a decoder circuitry 550. The decoder processing circuit 550 converts the coded data to generate a reproduced speech signal 530 that is substantially perceptually indistinguishable from the speech signal 520.

In the specific embodiment of the speech codec 500 illustrated in the FIG. 5, the encoder circuitry 540 contains, among other things, a reference shifting circuitry 542 that is used to perform modification of a target signal ($T_g$) that is generated during speech coding performed within the encoder circuitry 542. The target signal ($T_g$) itself is calculated using a target signal ($T_g$) calculation circuitry 542*a* that is located within the reference shifting circuitry 542. The target signal ($T_g$ calculation circuitry 542*a* provides the calculated target signal ($T_g$) to a target signal ($T_g$) modification circuitry 542*aa*. It is within the target signal ($T_g$) modification circuitry 542*aa* that the target signal reference shifting is performed in accordance with the present invention. In addition to calculating a modified target signal ($T_g$) is using the target signal ($T_g$) modification circuitry 542*aa*, the reference shifting circuitry 542 employs an adaptive codebook gain ($g_p$) calculation circuitry 542*b* to calculate an adaptive codebook gain ($g_p$) that is used to perform speech coding in accordance with the present invention. In certain embodiments of the invention, the modified target signal ($T_g$) is used to perform the calculation of the adaptive codebook gain ($g_p$). That is to say, the modified target signal ($T_g$) is the ultimate target signal ($T_g$) that is used to select the adaptive codebook gain ($g_p$) during speech coding of a speech signal in accordance with speech coding performed using the speech codec 500 illustrated in the FIG. 5.

In certain embodiments of the invention, the decoder circuitry 550 includes speech reproduction circuitry. Similarly, the encoder circuitry 540 includes selection circuitry that is operable to select from a plurality of coding modes. The communication link 510 is either a wireless or a wireline communication link without departing from the scope and spirit of the invention. Also, the communication link 510 is a network capable of handling the transmission of speech signals in other embodiments of the invention. Examples of such networks include, but are not limited to, internet and intra-net networks capable of handling such transmission. If desired, the encoder circuitry 540 identifies at least one perceptual characteristic of the speech signal and selects an appropriate speech signal coding scheme depending on the at least one perceptual characteristic. The speech codec 500 is, in one embodiment, a multi-rate speech codec that performs speech coding on the speech signal 520 using the encoder circuitry 540 and the decoder circuitry 550. The speech codec 500 is operable to employ code-excited linear prediction speech coding as well as a modified form of code-excited linear prediction speech coding capable of performing target signal reference shifting in accordance with the present invention.

Figure 6:
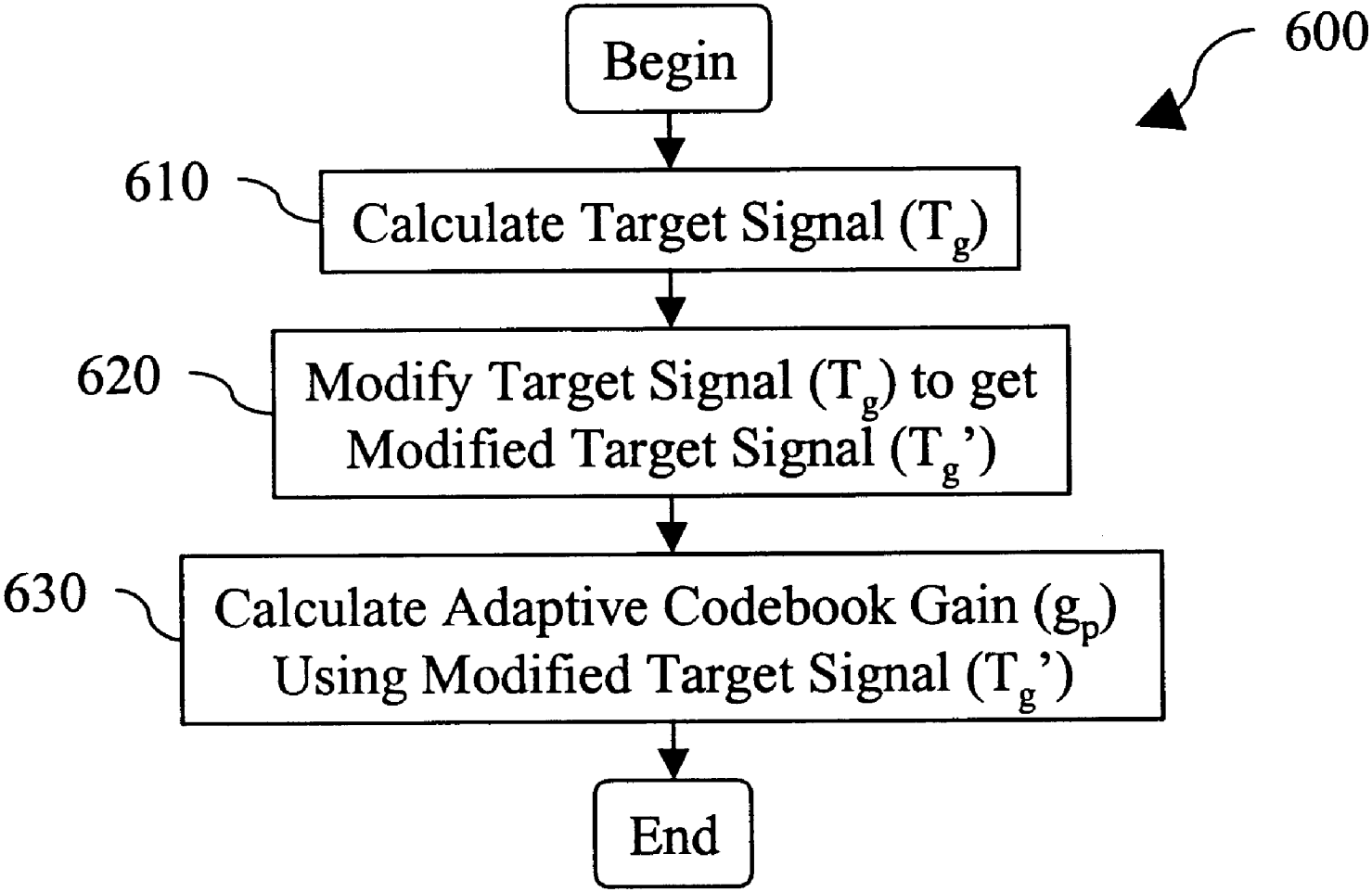
FIG. 6 is a functional block diagram illustrating a speech coding method performed in accordance with the present invention.

FIG. 6 is a functional block diagram illustrating a speech coding method 600 performed in accordance with the present invention. In a block 610, a target signal ($T_g$) is calculated. Subsequently, in a block 620, the target signal ($T_g$) that is calculated in the block 610 is modified to attain a modified target signal ($T_g'$). After the target signal ($T_g$) has been modified to achieve the modified target signal ($T_g'$) in the block 620, an adaptive codebook gain ($g_p$) is calculated in a block 630 using the modified target signal ($T_g'$) that is calculated in the block 620.

The speech coding method 600 performs target signal reference shifting in accordance with the present invention by modifying the target signal ($T_g$) calculated in the block 610 to generate the modified target signal ($T_g'$) calculated in the block 620. The speech coding method 600 provides for a way to decrease the bit-rate necessitated for coding the fractional pitch lag delay required during the calculation of pitch prediction integrated circuit code-excited linear prediction speech coding systems. In certain embodiments of the invention, the modified target signal ($T_g'$) calculated in the block 620 does not provide any substantially perceptually distinguishable difference from the target signal ($T_g$) calculated in the block 610.

Figure 7:
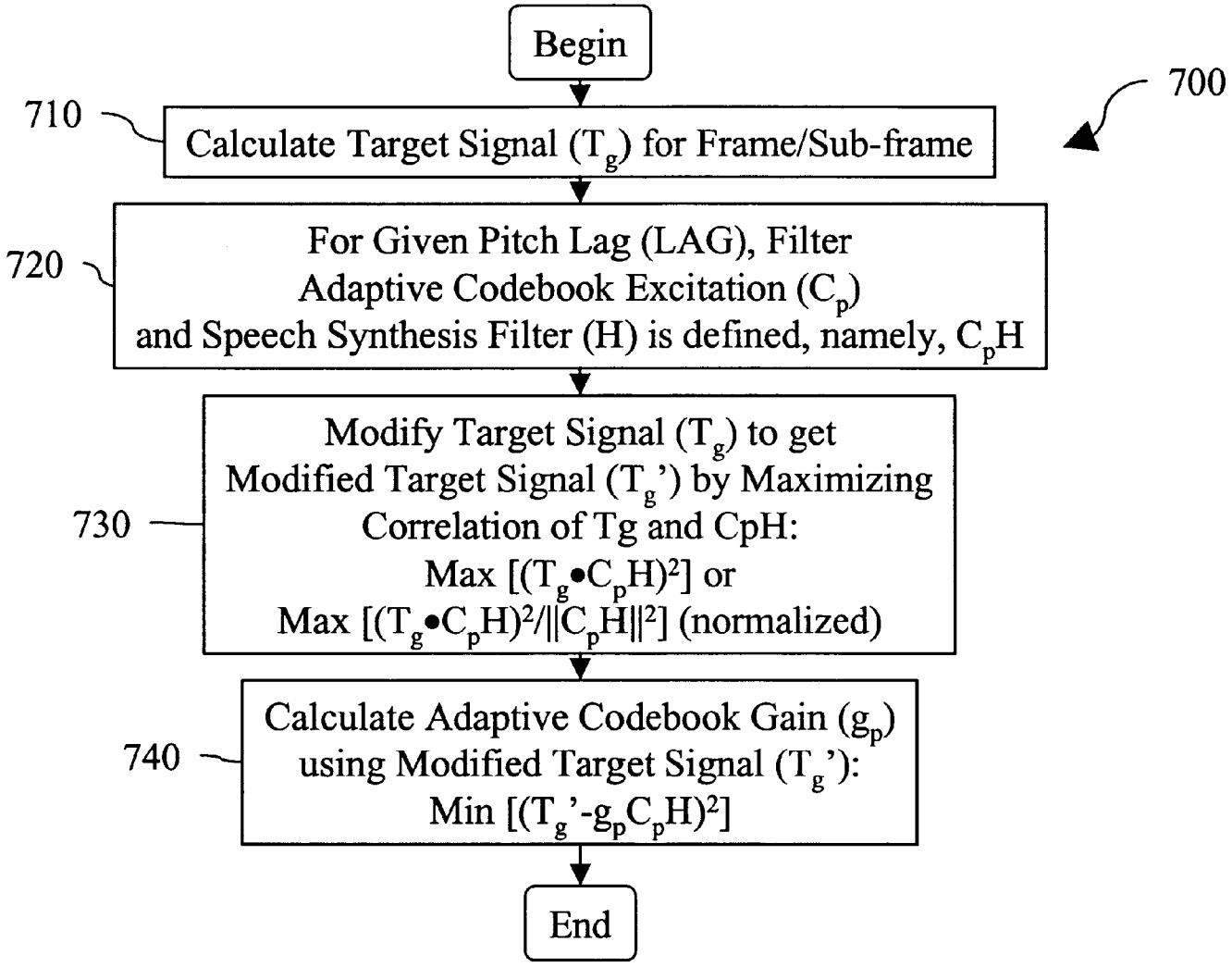
FIG. 7 is a functional block diagram illustrating a speech coding method that is a specific embodiment of the speech coding method of FIG. 6.

FIG. 7 is a functional block diagram illustrating a speech coding method 700 that is a specific embodiment of the speech coding method 600 as shown above in FIG. 6. In a block 710, a target signal ($T_g$) is calculated for either a frame or a sub-frame. As a speech signal is provided to be coded using the method 700, the speech signal is partitioned into a number of frames. The frames of the speech signal are further partitioned into a number of sub-frames. The calculation of the target signal ($T_g$) is performed either on a frame of the speech signal or on a sub-frame of a frame of the speech signal without departing from the scope of the present invention.

Subsequently, in a block 720, for a given pitch lag (LAG), an adaptive codebook excitation ($C_p$) is filtered and a speech synthesis filter (H) is defined. The combination of both the generation of the adaptive codebook excitation ($C_p$) and the speech synthesis filter (H) provides for the product of ($C_pH$) as required in accordance with code-excited linear prediction speech coding. Then, in a block 730, the target signal ($T_g$) calculated in the block 710 to generate the modified target signal ($T_g'$). In the embodiment shown in the speech coding method 700 of FIG. 7, the modified target signal ($T_g'$) is generated by finding the value of target signal ($T_g$) that maximizes the correlation of the dot product of the target signal ($T_g$) found originally in the block 710 and the product ($C_pH$) as found above in the block 720. The maximization of the dot product between the target signal ($T_g$) and the product ($C_pH$) is shown as $\mathrm{Max}[(T_g \cdot C_pH)^2]$, or alternatively as the maximization of the normalized dot product between the target signal ($T_g$) and the product ($C_pH$) that is shown as $\mathrm{Max}[(T_g \cdot C_pH)^2/\|C_pH\|^2]$ in the block 730. For clarity, the calculation of the maximization of the dot product between the target signal ($T_g$) and the product ($C_pH$) is shown below.

$$T_g' \leftarrow \mathrm{Max}\{(T_g \cdot C_pH)^2\}$$

From this, the product of an adaptive codebook contribution ($C_p$) and subsequently the contribution provided by a speech synthesis filter (H), and the product of those two elements, namely, $C_pH$ is then defined. Alternatively, if the maximization of the normalized dot product between the target signal ($T_g$) and the product ($C_pH$) is desired, it is shown below.

$$T_g' \leftarrow \mathrm{Max}\ (T_g \cdot C_pH)^2$$

$$\|C_pH\|^2$$

For each of the above situations, the target signal ($T_g$) is shown on the right hand side of the relation, and the modified target signal ($T_g'$) is provided on the left hand side of the relation.

Finally, in the block 740, an adaptive codebook gain ($g_p$) is calculated using the modified target signal ($T_g'$) that is calculated in the block 730. Specifically, the adaptive codebook gain ($g_p$) calculated in the block 740 is found by finding the adaptive codebook gain ($g_p$) that minimizes the equation of $\mathrm{Min}[(T_g'-g_pC_pH)^2]$. Once the modified target signal ($T_g'$) is found in the block 730, that modified target signal ($T_g'$) is used to find the specific adaptive codebook gain ($g_p$) in the block 740 for the speech coding method 700.

Lastly, and using the modified target signal ($T_g'$), it is possible to solve for the adaptive codebook gain ($g_p$) as shown below.

$$g_p \leftarrow \mathrm{Min}\ [(T_g'-g_pC_pH)^2]$$

In view of the above detailed description of the present invention and associated drawings, other modifications and variations will now become apparent to those skilled in the art. It should also be apparent that such other modifications and variations may be effected without departing from the spirit and scope of the present invention.

What is claimed is:

1. A code-excited liner prediction speech coding system that performs target signal reference shifting during encoding of a speech signal, comprising:

a speech synthesis filter, the speech syntheses filter comprising a linear prediction coding synthesis filter and a perceptual weighting filter, the speech synthesis filter generates a target signal during encoding of the speech signal usisng the linear prediction coding synthesis filter and the perceptual weighting filter;

the code-excited linear prediction speech coding system generates a modified target signal using the target signal that is generated during the encoding of the speech signal;

wherein the modified target signal is modified by shifting a phase of the target signal, the phase shift is determined by maximizing the correlation of the dot product of the target signal and the product of an adaptive codebook excitation and a speech synthesis filter.

2. The code-excited linear prediction speech coding system of claim 1, wherein the code-excited linear prediction speech coding system is contained within a speech codec.

3. The code-excited linear prediction speech coding system of claim 2, wherein the speech codec comprises an encoder circuitry, and the modified target signal is generated within the encoder circuitry.

4. The code-excited linear prediction speech coding system of claim 1, wherein the code-excited linear prediction speech coding system is operable within a speech signal processor.

5. The code-excited linear prediction speech coding system of claim 1, wherein the code-excited linear prediction speech coding system is operable within a substantially low bit-rate speech coding system.

6. The system of claim 1 wherein the modified target signal is modified by shifting the target signal.

7. The system of claim 1 wherein the code-excited linear prediction speech coding system generates an encoded speech signal during the encoding of the speech signal.

8. The code-excited linear prediction speech coding system of claim 7, wherein the encoding of the speech signal is performed on a frame basis.

9. The code-excited linear prediction speech coding system of claim 7, wherein the encoding of the speech signal is performed on a sub-frame basis.

10. The system of claim 1 wherein the code-excited linear prediction speech coding system decodes the encoded speech signal to generate a reproduced speech signal, the reproduced speech signal is substantially perceptual indistinguishable from the speech signal prior to encoding of the speech signal.

11. The system of claim 1 wherein the target signal and the modified target signal are a subframe target signal and a subframe modified target signal.

12. The code-excited linear prediction speech coding system of claim 10, wherein the reproduced speech signal is generated using the modified target signal.

13. A speech coding system that performs target signal reference shifting of a speech signal, the speech coding system comprising:

a target signal calculation circuitry that generates a target signal, the target signal corresponds to at least one portion of the speech signal;

a target signal modification circuitry that generates a modified target signal using the target signal; and wherein the modified target signal is modified by shifting a phase of the target signal, the phase shift is determined by maximizing a correlation of a dot product of the target signal and a product of an adaptive codebook excitation and a speech synthesis filter.

14. The speech coding system of claim 13, wherein the speech coding system is contained with in a speech codec.

15. The speech coding system of claim 14, wherein the speech codec comprises an encoder circuitry, and the speech coding system is contained within the encoder circuitry.

16. The speech coding system of claim 13, wherein the speech coding system is operable within a speech signal processor.

17. The speech coding system of claim 13, further comprising a speech synthesis filter, the speech synthesis filter comprising a linear prediction coding synthesis filter and a perceptual weighting filter.

18. The speech coding system of claim 13, wherein the at least one portion of the speech signal is a sub-frame of the speech signal.

19. The speech coding system of claim 13, wherein the speech coding system is operable within a substantially low bit-rate speech coding system.

20. A method to perform target signal reference shifting on a speech signal, the method comprising:

calculating a target signal, the target signal corresponds to at least one portion of the speech signal; and modifying the target signal to generate a modified target signal by shifting a phase of the target signal, where the phase shift is determined by maximizing the correlation of the dot product of the target signal and the product of an adaptive codebook excitation and a speech synthesis filter.

21. The method of claim 20, wherein the at least one portion of the speech signal is a sub-frame of the speech signal.

22. The method of claim 20, wherein the modifying the target signal to generate a modified target signal further comprises maximizing a correlation between the target signal and a product of an adaptive codebook contribution and a speech synthesis filter contribution.

23. The method of claim 22, wherein the correlation between the target signal and a product of an adaptive codebook contribution and a speech synthesis filter contribution is a normalized correlation.

24. The method of claim 20, wherein the method is performed using code-excited linear prediction speech coding.

* * * * *

UNITED STATES PATENT AND TRADEMARK OFFICE

CERTIFICATE OF CORRECTION

PATENT NO. : 6,581,030 B1
DATED : June 17, 2003
INVENTOR(S) : Huan-yu Su

It is certified that error appears in the above-identified patent and that said Letters Patent is hereby corrected as shown below:

Column 9,
Line 53, replace “syntheses”, with -- synthesis --.

Column 10,
Line 29, replace “perceptual”, with -- perceptually --.
Line 30, before “encoding”, add -- the --.

Signed and Sealed this

Sixteenth Day of September, 2003

JAMES E. ROGAN
*Director of the United States Patent and Trademark Office*